United States Patent [19]

Lehman

[11] 4,453,338

[45] * Jun. 12, 1984

[54] FINGER FLICKER SAUCER WITH SPRING POWERED TAB

[76] Inventor: James A. Lehman, 362 N. Seymour (Apt. 218), Fond du Lac, Wis. 54935

[ * ] Notice: The portion of the term of this patent subsequent to Apr. 14, 1998 has been disclaimed.

[21] Appl. No.: 371,566

[22] Filed: Apr. 26, 1982

Related U.S. Application Data

[63] Continuation-in-part of Ser. No. 328,365, Dec. 7, 1981, abandoned.

[51] Int. Cl.[3] ..... A63H 27/00

[52] U.S. Cl. ..... 446/46; 273/424

[58] Field of Search ..... 46/74 D, 75, 81; 273/424, 425, 427, 428

[56] References Cited

U.S. PATENT DOCUMENTS 1,542,012 6/1925 Spilman ..... 273/428 X 4,261,135 4/1981 Lehman ..... 46/74 D

*Primary Examiner*—Mickey Yu

[57] ABSTRACT

The invention pertains to an improved finger flickable flying saucer toy which has a spring and finger tab positioned from either the inner lip or inner body section. The face of the tab is always approximately in line with the radius of the saucer so that the energy imparted to it always results in a flight path that is in line with the direction that the face of the tab is aimed. The spring greatly facilitates launching and enables the user to often achieve long distance flights.

8 Claims, 8 Drawing Figures

FINGER FLICKER SAUCER WITH SPRING POWERED TAB

BACKGROUND OF THE INVENTION

The invention is a continuation-in-part application, Ser. No. 328,365 filed Dec. 7, 1981, now abandoned, on a Finger Flicker Saucer With Leaf Spring Tab. That application related to a toy flying saucer which is a modification and improvement upon a Finger Flicker Flying Saucer Toy developed by the inventor and for which a patent has been granted having U.S. Pat. No. 4,261,135. The original Finger Flicker is very similar to the present invention, but certain problems inherent in a fixedly secured tab were discovered and resolved by the present invention.

SUMMARY OF THE INVENTION

The instant invention overcomes the above deficiency by providing a power assist to the launching tab, the power assist being in the form of a spring, a leaf spring, a coil spring or the like, which is positioned between the tab and the lip of the saucer body. The spring greatly facilitates launching allowing even small children to produce flight paths of considerable length.

These and other features and objects of the invention will be apparent to those familiar with this art as the description continues while being read in conjunction with the appended drawings.

DETAILED DESCRIPTION OF THE EMBODIMENTS

Figure 1:
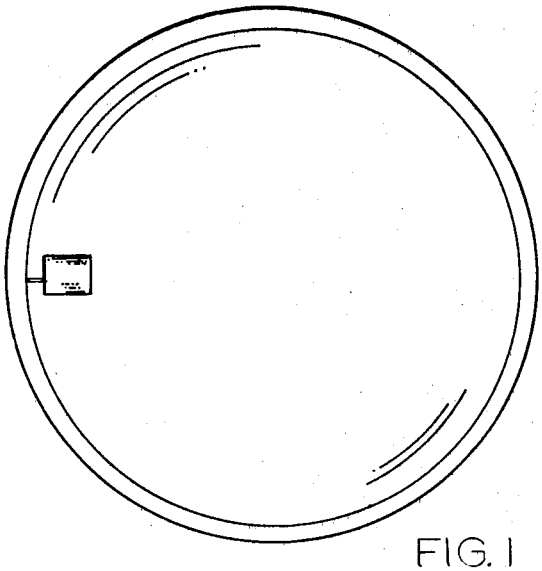
FIG. 1. depicts a slightly reduced view of the underside of the saucer.

The saucer leaf spring 10, refer to FIGS. 1, 2, 3, 4, and 5, is made of spring steel material, but may be made of plastic as is the saucer. The spring 10, may be molded into finger tab 12, and then that sub assembly may be molded into the lip of the saucer via the insert molding process, refer to FIGS. 4 & 5 which show the tab and spring thus molded. However, the spring and tab may be integral with the saucer, and may be molded into the saucer at the same time that the saucer is molded.

To launch the saucer the user places his index finger nail against the face 15, of the tab 12, and then clamps his thumb over the top of the index finger and on to the top of the saucer 14. He then compresses the tab to position 13, refer to FIG. 5, where the tab makes contact with the saucers lip and comes to rest. Launching is then accomplished by releasing the thumb which in turn then allows the compressed tab to push away from the index finger resulting in the saucer being put into flight. Extra energy may be imparted to the saucer by giving a flick of the index finger at the time it separates from the tab, and even further energy may be added by pushing the arm out from the body at the same time.

Figure 6:
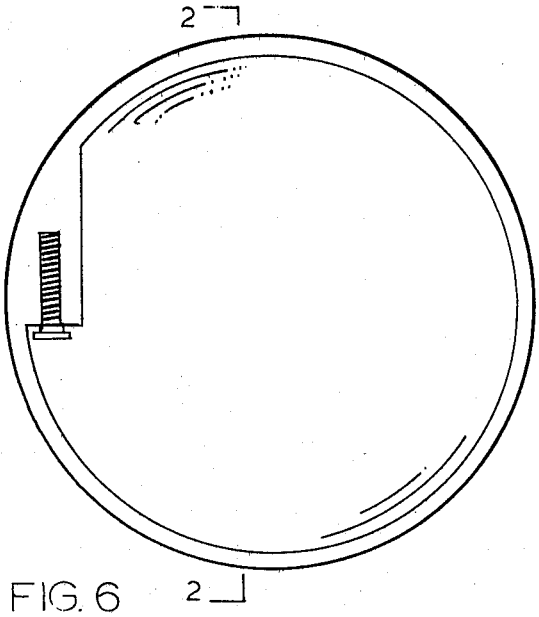
FIG. 6. is an underside view of the coil spring embodiment.
Figure 2:
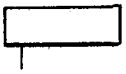
FIG. 2. is a side view of the leaf spring.
Figure 3:
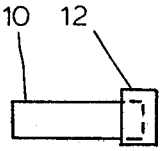
FIG. 3. is a side view of the leaf spring and finger tab combined.
Figure 4:
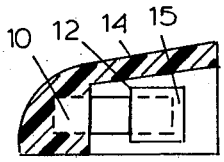
FIG. 4. is a sectional view of the leaf spring and tab when seen as molded into the lip of the saucer.
Figure 7:
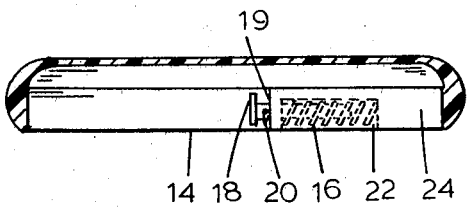
FIG. 7. is a cross sectional view of FIG. 6. taken along line 2—2.
Figure 5:
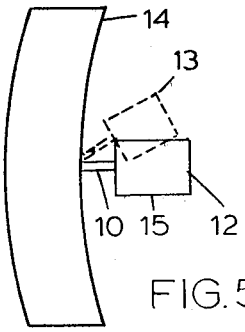
FIG. 5. is a magnified view of the finger tab showing its rest position and its flexed position—shown by the dotted lines.

The alternative embodiment of FIGS. 6 & 7 which has a coil spring located in the lip of the saucer is launched in a very similar fashion by compressing tab 18, until it comes to rest upon the face 19, of the spring housing 24. At this point the coil spring 16, is compressed in coil spring cavity 22, by compression tits 20, and the saucer is ready to be launched in the fashion previously described.

Figure 8:
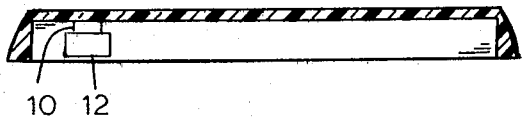
FIG. 8. shows a saucer with a leaf spring tab secured downward from the saucer body.

As can be seen in reviewing the drawings the leaf spring embodiment has its spring positioned in line with the radius of the saucer, and the coil spring embodiment has its spring located perpendicular to the radius of the saucer, but this matters little as the face of either tab is always approximately in line with the radius of the saucer, and thus the line of flight is always perpendicular to the radius of the saucer, and approximately in line with the direction that the index finger is pointing directly after launching, and this is even true with the embodiment of FIG. 8, which has its leaf spring 10, and tab 12, positioned downward from the saucer body.

Regarding the securing of the springs it should be noted that regardless of their configuration they may all be secured in any number of ways to either the lip of the saucer or to the body of the saucer by being press fitted, bonded or molded into the saucer.

Many changes may be made in the details of the instant invention, in the method and materials of fabrication, the configuration and the assemblage of the constituent elements, without departing from the spirit and scope of the appended claims, which changes are intended to be embraced therewithin.

Having thus described the invention, which is claimed as new and useful and desired to be secured by United States Letters Patent is:

1. An improved hand held finger flickable flying saucer toy comprising: a central body portion;

a curvi-linear air foil configured depending lip positioned around the periphery of said central body portion; and at least one launching tab extending toward the center of said central body portion and secured to the inner surface of said saucer by a spring whereby said flying saucer toy is launched by compressing the launching tab with the index finger and clamping the saucer to the hand with the thumb and then thereafter releasing the thumb which releases said saucer to the action of said spring to cause said saucer to withdraw from said index finger.

2. The invention as defined in claim 1, wherein said spring is a leaf spring positioned in line with the radius of the saucer.

3. The invention as defined in claim 1, wherein said launching tab and spring are secured to the inner surface of said depending lip.

4. The invention as defined in claim 1, wherein said launching tab and spring are secured to the inner surface of said central body portion.

5. The invention as defined in claim 4, wherein said launching tab and spring are positioned downward from said central body portion.

6. An improved hand held finger-flickable flying saucer toy comprising:

a central body portion;

a curvi-linear air foil configured depending lip positioned around the periphery of said central body portion; and at least one launching tab secured to the inner surface of said saucer by a coil spring whereby said flying saucer toy is launched by compressing the launching tab with the index finger and clamping the saucer to the hand with the thumb and then thereafter releasing the thumb which releases said saucer to the action of said spring to cause said saucer to withdraw from said index finger.

7. The invention as defined in claim 6, wherein said coil spring is positioned perpendicular with the radius of the saucer.

8. The invention as defined in claim 7, wherein said coil spring is provided with a spring housing secured to the inner surface of the body and lip of the saucer.

* * * * *